United States Patent [19]

Drott et al.

[11] 4,251,181

[45] Feb. 17, 1981

[54] IMPLEMENT COUPLING APPARATUS FOR BOOM-TYPE VEHICLE

[75] Inventors: Edward R. Drott; John C. Christenson, both of Wausau; Ralph E. Rathke, Merrill, all of Wis.

[73] Assignee: Loed Corporation, Wausau, Wis.

[21] Appl. No.: 52,600

[22] Filed: Jun. 27, 1979

Related U.S. Application Data

[63] Continuation of Ser. No. 879,900, Feb. 21, 1978, abandoned.

[51] Int. Cl.[3] ..... E02F 3/81

[52] U.S. Cl. ..... 414/723; 172/273

[58] Field of Search ..... 414/722, 723; 172/272-275; 37/117.5, 118 R

[56] References Cited

U.S. PATENT DOCUMENTS

| | | | |
|---|---|---|---|
| 2,710,464 | 6/1955 | Husting | 172/273 X |
| 2,963,183 | 12/1960 | Przybylski | 414/723 |
| 3,172,686 | 3/1965 | Beard | 172/272 X |
| 3,204,793 | 9/1965 | Lane | 414/723 X |
| 3,243,066 | 3/1966 | Gardner et al. | 414/723 |
| 3,269,570 | 8/1966 | Wallberg | 414/723 X |
| 3,272,264 | 9/1966 | Antolini | 172/273 |
| 3,417,886 | 12/1968 | Stuart | 414/723 |
| 3,556,323 | 1/1971 | Heimmermann | 414/723 |
| 3,705,656 | 12/1972 | Hunger et al. | 414/723 |
| 3,760,883 | 9/1973 | Birk | 414/723 X |
| 3,818,551 | 6/1974 | Coughran | 414/723 X |

FOREIGN PATENT DOCUMENTS

| | | | |
|---|---|---|---|
| 1431698 | 1/1969 | Fed. Rep. of Germany . | |
| 1279491 | 11/1961 | France | 414/723 |
| 91351 | 3/1958 | Norway . | |
| 216635 | 10/1967 | Sweden | 414/723 |
| 1089885 | 11/1967 | United Kingdom . | |
| 1161736 | 8/1969 | United Kingdom . | |
| 1369935 | 10/1974 | United Kingdom . | |
| 1381643 | 1/1975 | United Kingdom . | |
| 1405601 | 9/1975 | United Kingdom . | |
| 1492504 | 11/1977 | United Kingdom . | |

*Primary Examiner*—L. J. Paperner

*Attorney, Agent, or Firm*—Allegretti, Newitt, Witcoff & McAndrews

[57] ABSTRACT

A female coupling element is secured to a work implement, for locking engagement with a male coupling element pivotably mounted by a boss member at the end of a vehicle boom. The female coupling element includes a pair of curved surfaces positioned for receiving the end of the boom in riding engagement on the boss member. A hydraulic cylinder secured between the boom and the male coupling element relatively pivots the two coupling elements into mating engagement whereupon a separate locking pin carried by the male element is hydraulically actuated from within the vehicle cab for movement to a pin receiving bore carried by the female element, locking the two coupling elements together. The hydraulic cylinder is utilized after implement attachment to manipulate the work implement with respect to the vehicle boom.

4 Claims, 8 Drawing Figures

IMPLEMENT COUPLING APPARATUS FOR BOOM-TYPE VEHICLE

This is a continuation application of application Ser. No. 879,900, filed Feb. 21, 1978, abandoned.

BACKGROUND OF THE INVENTION

The present invention relates to implement attachment apparatus for work vehicles wherein an implement can be automatically attached to and released from the vehicle, and more particularly relates to automatic implement attachment apparatus for boom-type vehicles.

Heretofore automatic hitch or attachment apparatus has been devised for attaching various implements to tractors or other vehicles. The attachment apparatus is automatically operable to permit the operator of the vehicle to attach the implement to the vehicle without leaving the vehicle's cab. However, none of the automatic attachment apparatus of the prior art has been adapted for an efficient attachment of a work implement to a vehicle which has a single front end boom.

For example, U.S. Pat. No. 3,760,883 issued to B. Birk on Sept. 25, 1978 and U.S. Pat. No. 3,204,793, issued to G. Lane on Sept. 7, 1965 illustrate automatic implement attachment apparatus for vehicles having two pairs of lifting arms which are laterally spaced a fairly good distance, in front of the vehicle. The coupling apparatus is rectangular in shape and is secured across the front ends of the four arms in a position for engaging a hook assembly and pin receiving assembly carried by the implement.

Unlike such prior art devices which have four displaced sources of lift, boom-type vehicles have a single point source at the boom's end where the work implement is to be secured. To place the prior art, large, rectangular coupler on the end of a boom would require several supporting members positioned around the coupler for attaching the four corners of the coupler to the boom end in order to stabilize the coupler. However, such a coupling arrangement would receive large force stresses on the supporting structure, particularly when the implement, such as a scoop shovel, strikes an immovable obstruction. The lines of force occurring with a single boom-type vehicle makes an adaptation of such prior art devices impractical.

It is therefore an object of the present invention to provide an automatic coupling apparatus for a boom-type vehicle.

It is another object of the present invention to provide a coupling apparatus in which a power member used to couple the implement to the vehicle is also utilized after attachment to manipulate the implement.

It is yet another object of the present invention to provide an automatic coupling apparatus which is compact.

It is a more general object of the present invention to provide an improved automatic implement attachment apparatus for efficiently and readily attaching or releasing an implement from operative engagement with a vehicle.

SUMMARY OF THE INVENTION

The objectives of the present invention are accomplished in a pair of mateable elements, one of which is secured to the work implement while the other is mounted to the boom end for pivoting about a single axis of rotation. The implement-secured element is adapted to engage the boom end in a manner for independent pivoting about the single axis, and a power driver is operable for pivoting the two elements together into mating engagement for securement. The power member thereafter is operable to pivot the work implement with respect to the boom.

Other objects, features and advantages of the present invention will be readily apparent from the following detailed description of the preferred embodiment taken in conjunction with the appended claims and accompanying drawings.

DESCRIPTION OF THE PREFERRED EMBODIMENT

Figure 1:
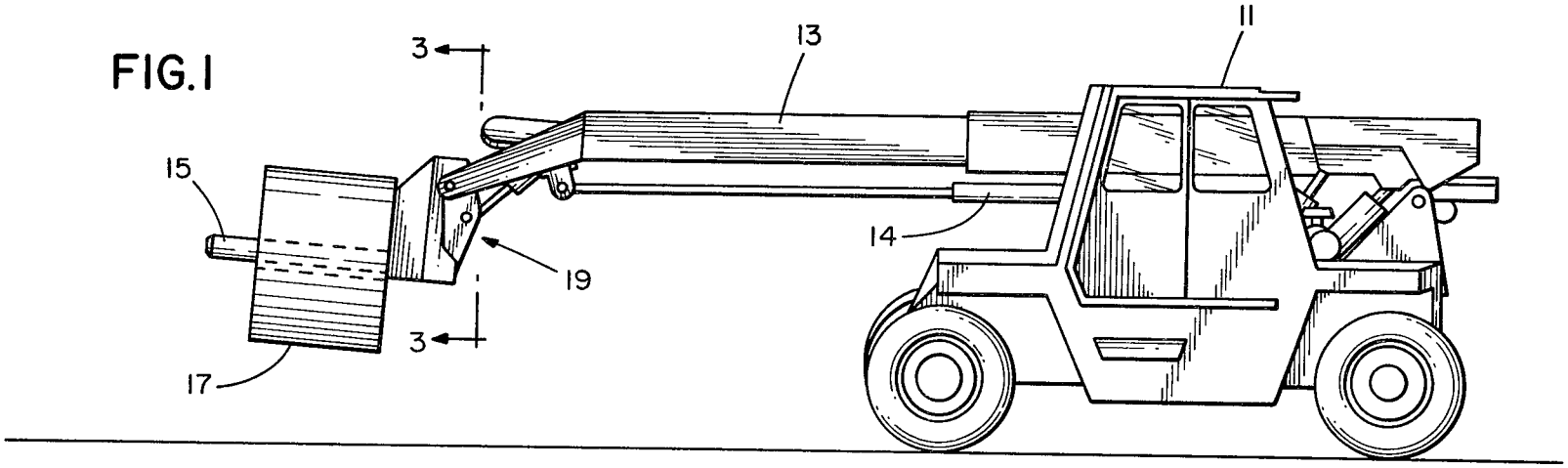
FIG. 1 is a side view of a boom-type vehicle utilizing an embodiment of the coupling apparatus of the present invention.

Referring to FIG. 1, a driving vehicle 11 carries a boom 13 which is conventionally telescopic by hydraulic cylinder 14 for varying the boom's extended position. The boom also is mounted to vehicle 11 for pivotal movement to vertically raise and lower the boom with respect to ground, and also may be mounted to provide a horizontal movement with respect to the ground.

The boom of vehicle 11 is adapted to be used with any of a number of work implements, and, in this regard, an implement 15 is illustrated comprising a lifting shaft for picking up a paper roll 17, or the like, via the roll core. Implement 15 is of conventional construction and is secured to boom 13 by a coupling apparatus 19.

Figure 2:
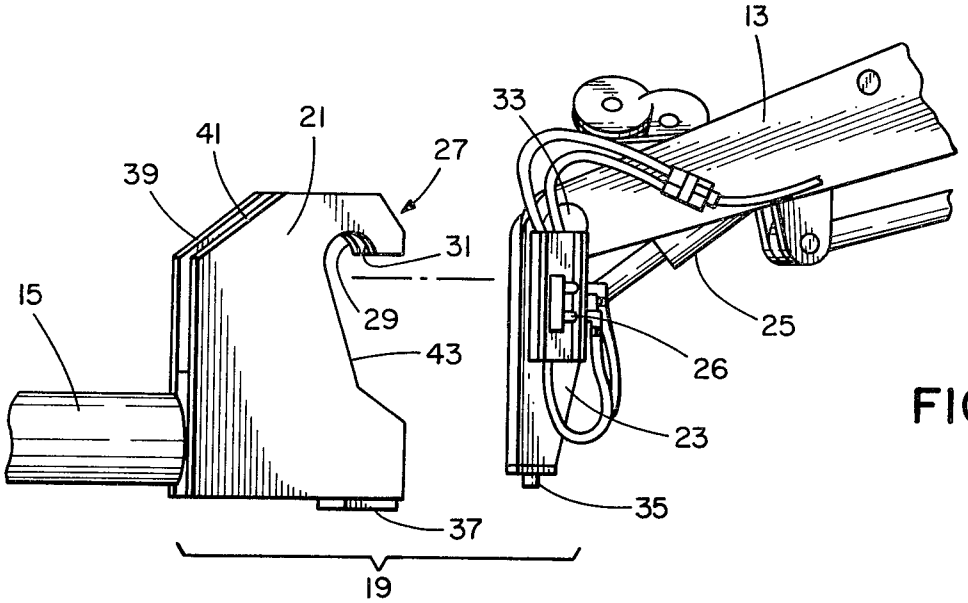
FIG. 2 is a side perspective view of the male and female elements of the coupling apparatus of FIG. 1.

FIG. 2 illustrates coupling apparatus 19 in a decoupled position, showing implement 15 secured to a female element 21 which is designed for a semi-permanent attachment to a male element 23 carried at the end of boom 13. Male element 23 is pivotally mounted to the boom end and is controllable from within the cab for pivoting by operation of a hydraulic cylinder 25. A set of hydraulic lines 26 may be mounted to male element 23, if desired, for hydraulic communication to the work element.

Female element 21, includes a hooking portion 27 bearing pivotal mounting surfaces 29,31 for mounting onto a cylindrical shaped boss 33 which is disposed in the boom end and to which male element 23 is secured for pivoting. A locking pin 35 is located at the base of male element 23 and is operable for movement into a pin receiving bore carried by an alignment bar 37 of the female element, for locking the male and female elements together.

The female element is formed of a pair of planar side plates 38,41 disposed in a parallel, spaced-apart relationship with each side plate bearing a pivotal surface 29,31, respectively. Pivotal mounting surfaces 29,31 are semicircular in shape and are symmetrically positioned about a vertical axis when the implement assumes a normal work position. The area of the plates beneath surfaces 29,31 is opened to the outside of the plates to permit boss 33 to be moved sidewise into the plates beneath surfaces 29,31, and then to be moved vertically upward for mating engagement therewith. A surface portion 43 of each plate defines the opening beneath mounting surfaces 29,31 and maybe configured for guiding the boss into its engagement position with mounting surfaces 29,31.

Figure 4:
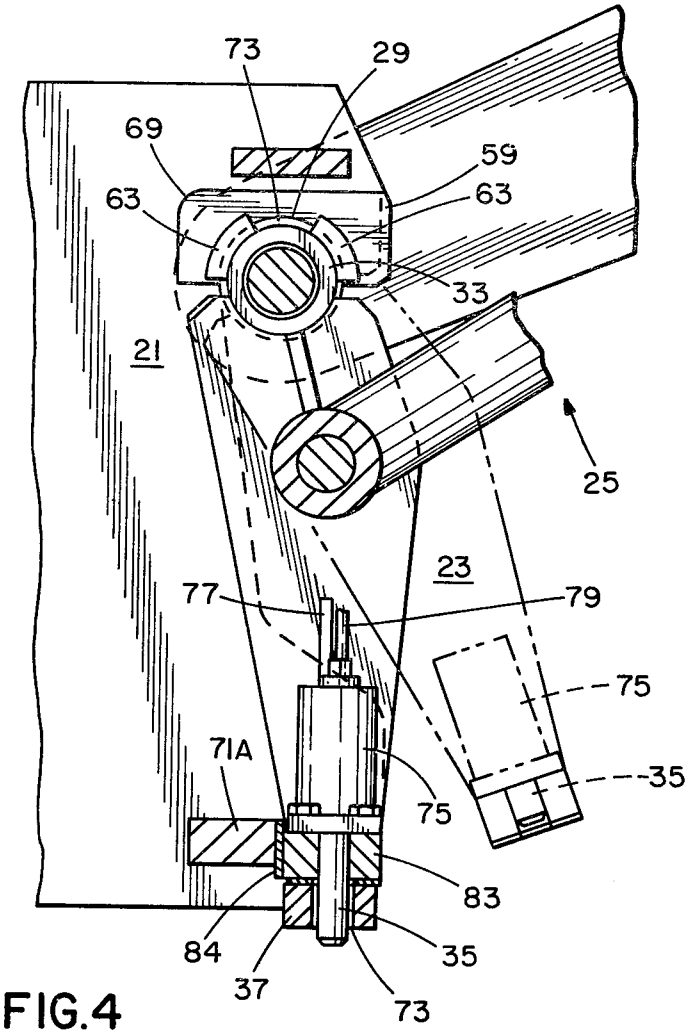
FIG. 4 is a detailed cut away side view of FIG. 3 taken along line 4—4.
Figure 3:
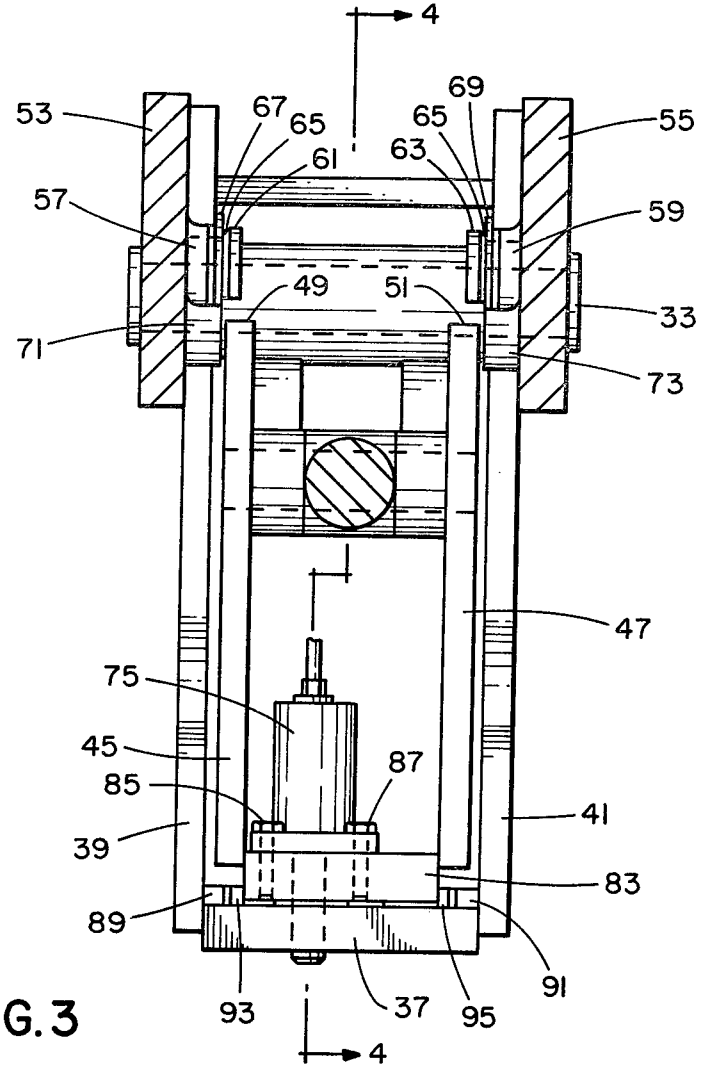
FIG. 3 is a detailed front view of the male and female elements of FIG. 2 in a coupled configuration.

Referring to FIGS. 3 and 4, male element 23 is shown in more detail, being formed of a pair of planar side plates 45,47 disposed in a parallel, spaced-apart relationship, having top ends 49,51 secured to cylindrical boss 33 by weldment or the like. Boss 33 is rotatably mounted to the boom sides 53,55 permitting male element 23 to pivotally move with respect to the boom.

Plates 45,47 are disposed in planes parallel to boom sides 53,55 and are positioned to the inside of the boom sides providing a spacing therebetween of a magnitude greater than the thickness of female element side plates 39,41. The spacing permits mounting surfaces 29,31 of the female element to freely move between the outside of the male element and the inside of the boom for engagement with boss 33 as shown in FIG. 3.

Side plates 39,41 of the female element are contoured at 57,59 for aiding guiding of boom sides 53,55 to the outside of female element plates 39,41 as boss 33 seeks to engage mounting surfaces 29,31.

Two pairs of guide collars 61,63 are secured to boss 33 and positioned to the outside of male element side plates 45,47 for guiding the inside of female element plates 39,41 into coupling position on boss 33. Each pair of guide collars are positioned along the upper periphery of the boss in a manner illustrated in FIG. 4, and each collar is contoured with a guide face 65 (FIG. 3) for guiding the female element into position on boss 33. Guide collar pairs 61,63 serve to space the male element sides from the female element sides to permit freedom of pivoting of the male and female element with respect to one another.

A pair of flat wear plates 67,69 are secured to the insides of female element plates 39,41 in the area of mounting surfaces 29,31, providing a contact surface for engagement with guide collar pairs 61,63. As boss 33 is moved within female element 21 for engaging mounting surfaces 29,31, guide collar pairs 61,63 contact guide plates 67,69 for guiding the female element into its proper coupling location on boss 33.

Guide collar pairs 61,63 serve to position the female element 21 in a relatively close positional relationship with boom sides 53,55, while permitting male element 23 to maintain an independent spacing with respect to the female element.

After the coupling of female element 21 to boss 33, male element 23 is pivoted by hydraulic member 25 causing boss 33 to rotate on the curved mounting surfaces 29,31 of the female element. A pair of cylindrical wear plates 71,73 may be secured to boss 33 in the area established for engagement of female element mounting surfaces 29,31.

As shown in FIG. 4, female element 21 includes a stop bar 71A positioned at the base of the female element for halting the male element 23 as the same is pivoted between female side plates 39,41. Stop bar 71A is positioned for stopping male element 23 at a point of proper alignment above alignment block 37 in order that a pin receiving bore 73 of the alignment block is in a proper position for receiving locking pin 35 carried by the male element.

Locking pin 35 is the hydraulic cylinder rod of a hydraulic cylinder 75 which is secured to an abutment bar 83 by bolts 85,87. Hydraulic cylinder 75 is controllable via a pair of hydraulic lines 77,79 from within the vehicle cab for movement of the locking pin from between a non-extended position as shown in fathom lines of FIG. 4, to an extended position, as illustrated in bold lines.

As illustrated in FIG. 3, abutment bar 83 is disposed somewhat below the bottom ends of male element side plates 45,47 at a distance for abutting against stop bar 71, as illustrated in FIG. 4. Abutment bar 83 includes an alignment plate 84 providing a relatively flat surface for aligning the lower portion of the male element with stop bar 71.

A pair of guide bars 89,91 (FIG. 3) are positioned atop alignment bar 37 and disposed against female element side plates 39,41 for guiding abutment bar 83 into locking position as the same is pivoted within female element 21. Guide bars 89,91 are formed with guide surfaces 93,95 which are shaped to guide abutment bar 93 into position against stop bar 71.

Figure 5:
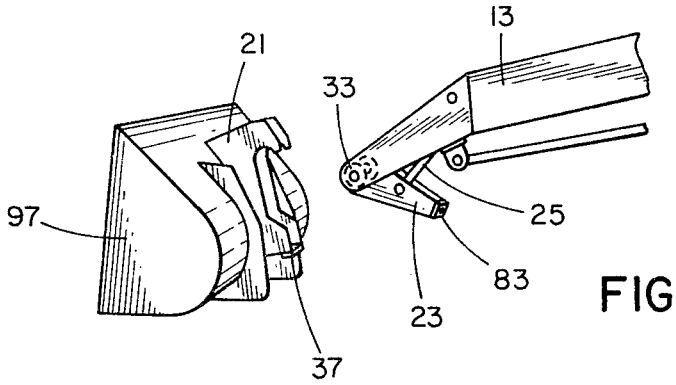
FIGS. 5–7 show the sequence of coupling of an implement to a boom end using the coupling apparatus of FIG. 1.
Figure 6:
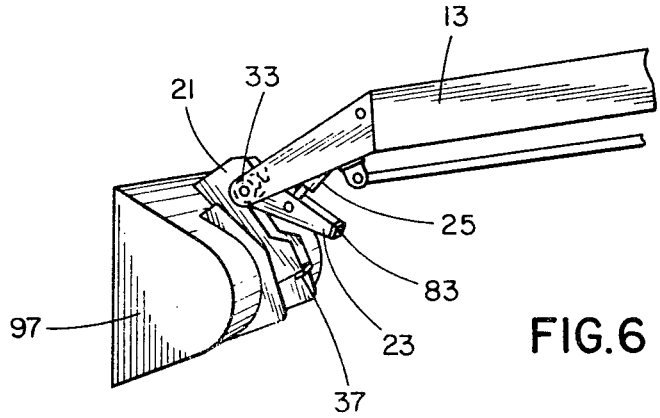
Figure 7:
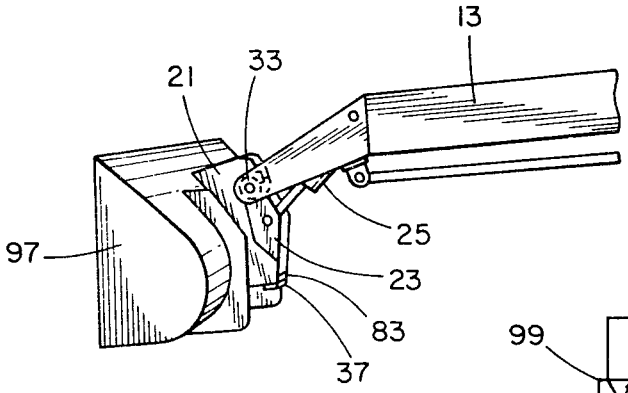

The sequence of the coupling operation is illustrated by FIGS. 5, 6 and 7, in which a shovel-scoop implement 97 is coupled to the boom end. As shown in FIG. 5, male element 23 is initially pivoted in a direction away from implement 97 leaving the area surrounding boss 33 unobstructed. The boom is then moved within the female element to position boss 33 onto the hook mounting surfaces, as shown in FIG. 6. From the position of FIG. 6, the boom is maintained stationary as hydraulic cylinder 25 is actuated, pivoting abutment bar 83 into position above alignment bar 37. Locking pin 35 is then moved into pin receiving bore 73 securely locking the coupling elements together as shown in FIG. 7. Once locked, hydraulic cylinder 25 may be used to manipulate implement 97 to perform its work functions.

Figure 8:
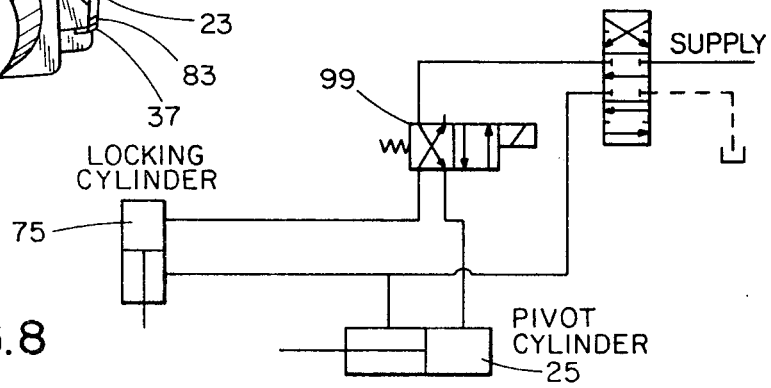
FIG. 8 shows a fluid flow schematic diagram of the hydraulic system utilized with the coupling apparatus of FIG. 1.

FIG. 8 illustrates a schematic diagram of the hydraulic fluid flow to operate the pin-locking cylinder 75 and the male-element pivot cylinder 25. A solenoid diverter valve 99 is switchable between two positions for independent operation of locking cylinder 75 or pivot cylinder 25.

It should be understood, of course, that the foregoing disclosure relates to a preferred embodiment of the invention and that other modifications or alterations may be made therein without departing from the spirit or scope of the invention as set forth in the appended claims.

What is claimed is:

1. A coupler assembly for selectively attaching a selected one of various work elements to a boom at the outer end thereof, said boom being operatively mounted on a vehicle, said coupler assembly comprising, in combination:

a first coupler element secured to said end of said boom for pivotal movement about an axis transverse to said boom;

hydraulic drive means operatively connected to both said boom and said first coupler element for pivoting said first coupler element about said axis relative to said boom;

a second coupler element secured to said one work element;

said first and second coupler elements including cooperating rigid, immobile means for partially interconnecting said first and second coupler elements;

cooperating lock means on both said first and second coupler elements for interlocking said coupler elements together after said cooperating means on said coupler elements are in said partially interconnected condition;

said cooperating lock means including a rigid lock member movably carried on said first coupler element for movement between a first position where said lock means are unlocked and a second position where said rigid lock member interlocks said lock means together;

drive means mounted on said first coupler element connected to said rigid lock member for moving said rigid lock member between said first and second positions; and control means on said vehicle, remote from said coupler elements, for operating said hydraulic drive means for pivotally moving said first coupler element and for moving said cooperating means into and out of said partially interconnected condition, said control means also operating said drive means for moving said rigid lock member between said first and second positions.

2. The coupler assembly of claim 1 wherein said first coupler element includes rigid boss means and said second coupler element includes rigid hook means, said boss means being received by said hook means.

3. The coupler assembly of claim 1 wherein said drive means comprises a hydraulic cylinder and said rigid lock member comprises a piston rod for said drive means.

4. The coupler assembly of claim 3 wherein said cooperating lock means includes a rigid plate having an opening therein, in each of said coupler elements, for receiving said piston rod.

* * * * *